United States Patent [19]

Zeitelhack

[11] Patent Number: 4,522,522

[45] Date of Patent: Jun. 11, 1985

[54] PENCIL HOLDER

[76] Inventor: Arthur R. Zeitelhack, 8711 Stark, Kansas City, Mo. 64138

[21] Appl. No.: 406,002

[22] Filed: Aug. 6, 1982

[51] Int. Cl.[3] ..... B43K 23/00

[52] U.S. Cl. ..... 401/88; 401/92; 401/93; 401/95

[58] Field of Search ..... D19/46; 401/88, 89, 401/90, 95, 92, 93, 94

[56] References Cited

U.S. PATENT DOCUMENTS

| | | | |
|---|---|---|---|
| D. 229,109 | 11/1973 | Lanoie | D19/46 |
| 775,097 | 11/1904 | Trump | 401/93 |
| 945,422 | 1/1910 | Schmitz | 401/93 |
| 1,127,882 | 2/1915 | Graffam | 401/92 |
| 1,144,082 | 6/1915 | Welton | 401/93 |
| 1,160,832 | 11/1915 | Borsella . | |
| 1,459,517 | 6/1923 | Sawyier . | |
| 1,677,387 | 7/1928 | Gaidos . | |
| 2,236,194 | 3/1941 | Lorber . | |
| 2,443,571 | 6/1948 | Wherry . | |
| 2,669,222 | 2/1954 | Larsen | 401/93 |
| 3,088,439 | 5/1963 | Van Dersal . | |
| 3,947,977 | 4/1976 | Bishop . | |
| 4,030,841 | 6/1977 | Balasty . | |
| 4,123,179 | 10/1978 | Pacheco . | |
| 4,167,347 | 9/1979 | Hoyle . | |
| 4,167,350 | 9/1979 | Horris . | |
| 4,200,403 | 4/1980 | Chu . | |

FOREIGN PATENT DOCUMENTS

| | | | |
|---|---|---|---|
| 638499 | 4/1962 | Italy | 401/93 |
| 531 | of 1860 | United Kingdom | 401/93 |
| 571173 | 8/1945 | United Kingdom | 401/95 |

*Primary Examiner*—Steven A. Bratlie

*Attorney, Agent, or Firm*—Litman, Day and McMahon

[57] ABSTRACT

A pencil holder includes first and second holder members having coaxial longitudinal through bores which are sized for receiving a pencil. A converging neck is located at a lower portion of the first holder and a chuck arrangement positioned at the juncture between the first and second holder members for gripping the pencil and maintaining its longitudinal positioning within the bore. The pencil tip protrudes through an aperture in the lower end of the first holder. Use of the pencil holder allows a writer to comfortably use pencils beyond a point at which the pencil would normally be discarded.

2 Claims, 4 Drawing Figures

PENCIL HOLDER

This invention relates to pencils and pens and in particular, to a holder for pencils from full length to a stub.

BACKGROUND OF THE INVENTION

Wood pencils have long been used as writing and drafting instruments, however, since the advent of the mechanical pencil, the percentage of users of wood pencils is thought to have been generally reduced by the proportional gain in users of mechanical pencils. The reason for popularity of the mechanical pencil are generally that such a pencil is light and comfortable in the user's pocket, has a retractable and substantially ever-sharp point for writing which does not puncture the user's pocket, has a replaceable eraser, and often provides more comfort and heft to the hand.

Wooden pencils remain in extensive use, however, most wooden pencils are used for approximately only two-thirds of their length before being discarded because they have become too short to be handily used or the integrated eraser has become worn out.

The present invention provides a pencil holder which greatly extends the life of a wood pencil, has replaceable erasers, provides sufficient heft and comfort to the hand of the user, has a retractable point, provides an attractive appearance, and substantially combines the advantages of a mechanical pencil with the economy of a wooden pencil.

OBJECTS OF THE INVENTION

The principal objects of the present invention are: to provide an improved pencil holder; to provide such a holder particularly adapted for standard wooden pencils; to provide such a holder which limits the protrusion of the point of the pencil from an end of the holder; to provide such a holder within which a pencil may be retracted for safe carrying and protection from torn pockets and human injury; to provide such a holder by which the life of a pencil may be extended beyond the point which the pencil otherwise becomes too short for use; to provide such a holder which may contain a pencil sharpened at both ends and in which the pencil can be reversed to present a new point for use; to provide such a holder adapted to receive a replaceable eraser element; to provide such a holder including a spring clip for retaining the holder in the pocket of a user; to provide such a holder which is adapted for writing comfort; to provide a holder which increases the useful life of a wood pencil; and to provide such a pencil holder which is economical to manufacture, attractive in appearance, durable in use and which is particularly well adapted for its intended purpose.

Other objects and advantages of this invention will become apparent from the following description taken in conjunction with the accompanying drawings wherein are set forth, by way of illustration and example, certain embodiments of this invention.

DESCRIPTION OF THE PREFERRED EMBODIMENT

Figure 1:
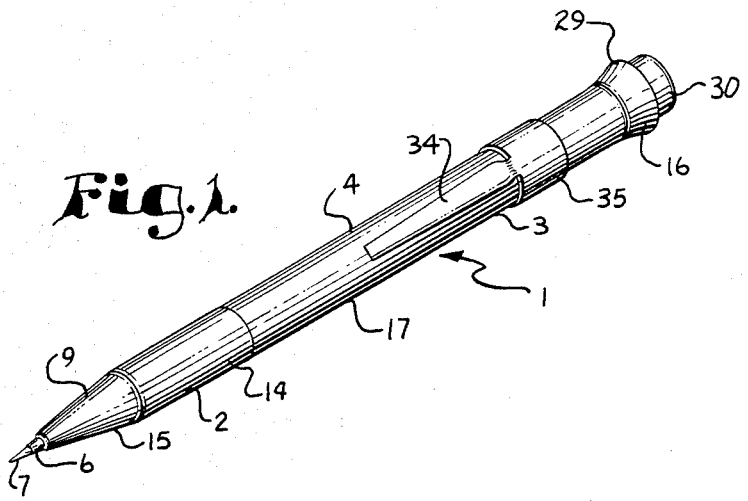
FIG. 1 is a perspective view of a pencil holder embodying the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
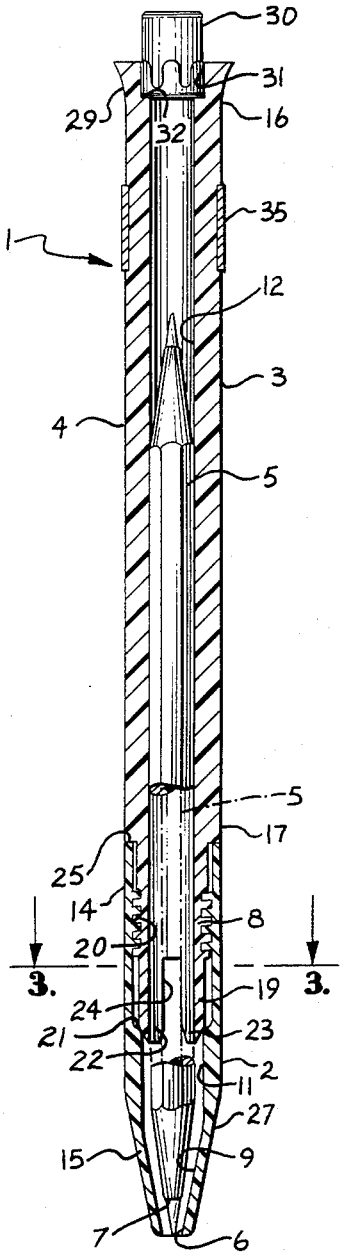
FIG. 2 is an enlarged longitudinal sectional view of the pencil holder.

Referring to the drawings in more detail:

The reference numeral 1, FIGS. 1 and 2 generally indicates a pencil holder embodying the present invention. The pencil holder 1 includes first and second holder members 2 and 3 forming a holder body 4 and having coaxial longitudinal through bores combining to form a single bore within the body. The body is of a compact size and shape for ease of use and carrying and the bores are sized for relatively snugly receiving a pencil 5. A lower end of the holder body 4 has an aperture through which the pencil tip 7 protrudes for writing.

An adjustable chuck means 8 is positioned between the first and second holders 2 and 3 for gripping the pencil 5 and maintaining the longitudinal positioning thereof in the combined bore of the body 4. An inner collet or neck 9 at the lower end of the body 4 provides a shoulder or a constriction for gripping the pencil 5 adjacent to the tip 7, with the inner neck 9 and the chuck means 8 cooperating to retain the pencil 5 engaged and correctly positioned in the body 4.

In the illustrated example, the first and second holder members 2 and 3 are in the form of elongate tubes which form the holder body 4 and respectively have the coaxial longitudinal through bores 11 and 12 therethrough. Preferably, the holder 1 is sized for substantially or completely concealing a whole or unused pencil 5 and the bores 11 and 12 are also commensurately sized to admit with sufficient clearance the typical diameter dimension of a wood pencil.

The first holder member 2 has upper and lower end portions 14 and 15 and the second holder member has respective upper and lower end portions 16 and 17. The first and second holder members are connected together at a mid-portion or juncture and in the illustrated example, the first and second holder members 2 and 3 are threadably and separably mounted to each other with the lower end portion 17 of the second holder member 3 threadably connected to the upper end portion 14 of the first holder member 2. The first and second holder members 2 and 3 are in coaxial alignment both externally and internally wherein the bores 11 and 12 are coaxial.

The pencil holder 1 includes means releasably maintaining the pencil 5 in a selected position whereby the pencil can be positioned for use yet retracted without separating the holder members 2 and 3 during periods of nonuse or for transport, as for putting in one's pocket. In the illustrated example, there are two retaining means in the holder 1 with one of the holding means being defined by the inner collet or neck 9 and the other holding means by the chuck means 8. In the illustrated example, the inner neck 9 is located at the lower end portion 15 of the first holder member 2 and the chuck means 8 is located at the juncture between the upper end portion 14 and the lower end portion 17. Both the chuck means 8 and the inner collet or neck 9 have coverging walls at the respective bores 11 and 12 providing inner necks for gripping the circumference of the pencil 5 and maintaining the longitudinal positioning thereof in the combined bores 11 and 12.

The exemplary chuck means 8 includes a multiple threaded outer wall 19 extending downwardly from the second holder member lower end portion 17 and forming a male collet portion 19 receivable in a female or receptacle 20 of the upper end portion 14 of the first holder member 2. A fillet 21 extends annularly around the interior surface of receptacle 20 and provides a tapered or sloping surface. The downwardly extending male portion 19 is comprised of a collet of first and second split leaves 22 and 23 separated by diametrically opposed slots 24 which extend upwardly in the second holder member 3, FIG. 2, and incompletely close as the leaves 22 and 23 are urged together by the advancement of the threaded connection between the first and second holder members 2 and 3. By engagement with the chuck fillet 21 of the first holder member 2, leaves 22 and 23 are urged together and form a constricting neck which engages the outer or circumferential surface of the pencil 5 and provides a grip thereon to prevent longitudinal movement of the pencil 5 within the combined bores 11 and 12. Full constriction of the leaves 22 and 23 to form the means engaging the pencil or the neck is determined by the first and second holder members 2 and 3 having confronting shoulders 25 in abutment.

The bore 11 in the first holder member 2 tapers or necks inwardly at the lower end portion 15 to provide the inner neck 9 which acts as a collet to engage a lower portion of the pencil 5 and to prevent further outward movement thereof, as at FIG. 2. The combination of the inner neck 9 and the chuck means 8 grips the pencil and maintains the longitudinal positioning thereof in the bores 11 and 12. The outer wall or surface of the lower end portion 15 of the first holder member 2 has a narrowed tip 27 for ease of grasping and terminates at the end aperture 6 through which the pencil tip 7 protrudes for writing.

The exemplary upper end portion 16 of the second holder member 3 has an outwardly flaring wall 29 for inhibiting the pencil holder 1 from slipping from a writer's grasp. In the illustrated example, the upper end portion 16 is fitted with a removable and replaceable plug, shown here as eraser element 30, which is received in a counter bore 31 bottoming at a shoulder 32 and closing the top of the bore 12.

A retainer clip 34 is affixed to the second holder member 3 by spring band portions 35 to clip the holder 1 within the pocket of a user.

In use, a pencil may be placed in the holder 1 by threadably disconnecting the first holder member from the second holder member and the pencil 5 inserted through the chuck means 8. The two holder members 2 and 3 are then reconnected about the pencil 5 wherein the lower or point portion of the pencil 5 extends through the aperture 6 and the inner collet or neck 9 bears against the pencil and tends to push it upwardly into the second holder member 3 as the holder members 2 and 3 are reconnected. The holder members 2 and 3 are rotated in threaded engagement which urges the clamp means leaves 22 and 23 downward and inwardly to meet the internal fillet 21 and engage the pencil 5 wherein the pencil is held between two engagement points. Since this engagement of the leaves 22 and 23 with the fillet 21 is accomplished during the last few degrees of rotation of the first holder member 2 onto the second holder member 3, loosening of the chuck means 8 is accomplished with very little reverse rotation.

To protect the pencil tip 7 when the pencil is not in use, a slight loosening of the holder members 2 and 3 releases the grip of the chuck means 8 from the pencil 5 and enables the pencil 5 to be retracted by pushing the point into the body 4. The pencil 5 is then secured therein by retightening or retwisting the holder members 2 and 3 relative to each other.

To sharpen a new pencil point, the second holder member 3 is completely separated from the first holder member 2 by threadably detaching same and pulling the pencil 5 from the chuck means 8. The pencil can be resharpened repeatedly until it wears to a nub or until the spacing from the chuck means 8 to the inner neck 9, such as $1\frac{1}{2}$ inches, is no longer sufficient to grip the pencil and at this time the nub is removed and a new pencil is inserted. Both ends of a pencil 5 may be sharpened, FIG. 2, or the pencil merely taken out and reversed should a new tip be required and a sharpener is not readily available. The user may also replace the eraser element 30 as it becomes excessively worn, providing a substantially longer lifespan than the useful length of normal wood pencils.

The pencil holder 1 is particularly useful when using the double ended red/blue pencils wherein the holder can be quickly taken apart and the red/blue pencil reversed in position to present the next color for use. Indeed, various colors of the leads of the pencils 5 can be matched with various colors of the pencil holder 1 for quick visual match.

Figure 4:
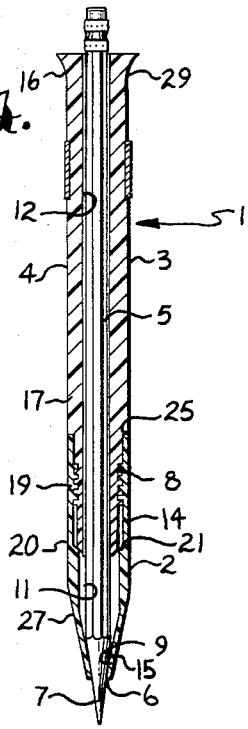
FIG. 4 is a longitudinal sectional view of an alternate embodiment of the pencil holder.
Figure 3:
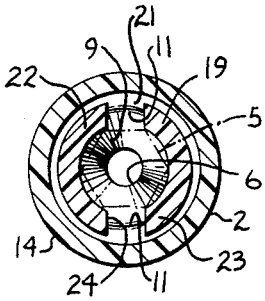
FIG. 3 is a cross-sectional view taken along lines 3—3, FIG. 2 and having the pencil therein removed for purposes of clarity.

FIG. 4 represents an alternative embodiment of the present invention. The numbers used in FIG. 4 which are identical to those used in FIGS. 1, 2 and 3 indicate simialr structure. The embodiment disclosed in FIG. 4, is without the counterbore 31 and shoulder 32 of the embodiment shown in FIG. 2. FIG. 4 shows the holder 1 with a pencil 5 extending all the way therethrough. However, if a pencil 5 whose entire length is shorter thn the length of the holder 1 is used, a plug or eraser, not shown, may be inserted into the upper end portion 16 to plug the end of the bore 12.

It is to be understood that while certain forms of the present invention have been illustrated and described herein, it is not to be limited to the specific forms or arrangement of parts described and shown.

What is claimed and desired to secure by Letters Patent is as follows:

1. A pencil holder for retaining a wooden pencil and comprising:

(a) first and second holder members coaxially aligned having a through bore, and forming a holder body, said body and said bore being sized to receive a wooden pencil;

(b) said first holder member being approximately one third of a length of said body, and having a lower open ended tip formed by a converging conical neck with an aperture so that a conical pencil tip may extend partially therethrough and the remainder firmly abutting against said neck surrounding said aperture; said first holder member haivng an upper end portion with interior threads and an interior annular wall constriction angling sharply toward said bore and positioned between said interior threads and said neck; and (c) said second holder member having a lower end forming a chuck having external threads and split leaves with a sloping end wall on said leaves selectively engagable with said interior annular wall constriction;

(d) whereby when said first holder member is screwed toward said second holder member said leaves advance and encounter said interior annular wall constriction and flex inwardly into said through bore to firmly engage said leaves end wall with a pencil outer surface received therein for maintaing said pencil in retracted position within said bore and in an extended position, in combination with said converging conical neck, firmly supporting and maintaining said pencil in said extended position in a two position grip.

2. The pencil holder set forth in claim 1 wherein:

(a) said first holder member has an end shoulder at said upper end portion; and (b) said second holder member has a confronting end shoulder spaced upwardly of said external threads and said split leaves;

(c) said end shoulder and said confronting end shoulder selectively abutting and providing a stop upon relative rotation of said first and second holder members.

* * * * *